United States Patent [19]

Pogue

[11] Patent Number: 4,702,826

[45] Date of Patent: Oct. 27, 1987

[54] SCREEN CLEANER FOR PARTICLE SIZE ANALYZER

[75] Inventor: Glenn J. Pogue, Cincinnati, Ohio

[73] Assignee: Rotex, Inc., Cincinnati, Ohio

[21] Appl. No.: 825,149

[22] Filed: Feb. 3, 1986

[51] Int. Cl.[4] ..... B07B 1/52

[52] U.S. Cl. ..... 209/237; 209/239; 209/309; 209/379; 209/385; 209/386

[58] Field of Search ..... 209/625, 627, 628, 659, 209/660, 680, 683, 284, 287, 288, 289, 309, 379, 384, 385–390, 404, 406–408, 237, 239, 235

[56] References Cited

U.S. PATENT DOCUMENTS

| | | | |
|---|---|---|---|
| 65,504 | 6/1867 | Pryor . | |
| 256,066 | 4/1882 | Stansfield | 209/390 |
| 624,965 | 5/1899 | Oester | 209/386 |
| 735,713 | 8/1903 | Crofoot | 209/386 |
| 1,746,555 | 2/1930 | Plimpton . | |
| 1,930,890 | 10/1933 | Wallace . | |
| 2,478,246 | 8/1949 | Cortese et al. | 209/627 |
| 3,200,945 | 8/1965 | Cota . | |
| 3,351,200 | 11/1967 | Burenga . | |
| 3,708,806 | 1/1973 | Kemper . | |
| 3,972,813 | 8/1976 | Ziolkowski . | |
| 4,421,642 | 12/1983 | Kreitner et al. . | |
| 4,487,323 | 12/1984 | Marrs | 209/683 X |

FOREIGN PATENT DOCUMENTS

| | | | |
|---|---|---|---|
| 0621763 | 5/1927 | France | 209/390 |
| 0002319 | of 1878 | United Kingdom | 209/386 |
| 0019545 | of 1890 | United Kingdom | 209/390 |
| 0504007 | 4/1939 | United Kingdom | 209/407 |

*Primary Examiner*—Randolph A. Reese
*Assistant Examiner*—Edward M. Wacyra
*Attorney, Agent, or Firm*—Wood, Herron & Evans

[57] ABSTRACT

Disclosed is a device for sequentially cleaning the screens of a particle size analyzer of the indexing drum type, as each screen moves out of the screening position. The cleaning member is preferably removed from the drum during each screening step. The particles dislodged from the screen being cleaned are returned to the sample being analyzed in a manner which maintains the accuracy of the analysis. In an alternative embodiment, each screen is cleaned during a screening step, at an indexed position other than the screening position.

7 Claims, 2 Drawing Figures

SCREEN CLEANER FOR PARTICLE SIZE ANALYZER

FIELD OF THE INVENTION

Figure 1:
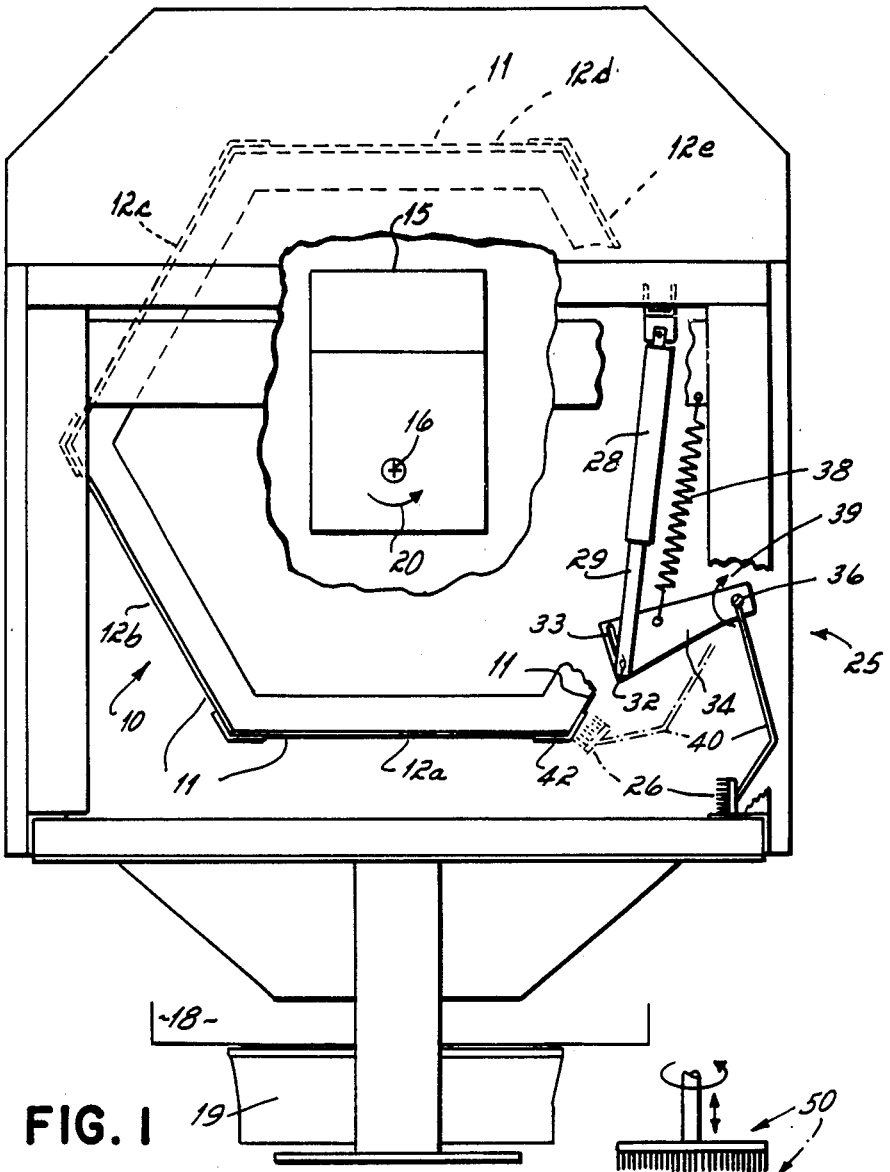

This invention relates to screening machines, and more particularly an apparatus and method for cleaning the screens of a particle size analyzer of the indexing drum type.

BACKGROUND OF THE INVENTION

Machines for determining the proportions of particles in different size ranges in a particulate sample are known as particle size analyzers. U.S. Pat. No. 4,487,323, to Gevan R. Marrs, issued Dec. 11, 1984, and entitled "Automatic Particle-Size Analyzer", discloses apparatus for automatically determining the proportions by weight of particles which pass through the different screens of a series of graduated mesh sizes. That analyzer has a rotatable, polygonal screen drum which mounts a series of graduated screens on its sides. The drum is indexed about a horizontal axis so that, beginning with the screen with the smallest openings, screens of increasingly larger mesh size are successively moved to a generally horizontal, lowermost or "down" screening position. The same to be analyzed is introduced into the interior of the drum and the drum is vibrated longitudinally or otherwise shaken to impart an effective screening motion which separates the particles on the screen in the "down" position.

A collector beneath the active screen receives and weighs the particles which pass through that screen; from this weight the sample percentage which has passed through that screen can be calculated. The drum is then automatically indexed to present the next larger screen at the down position, the remaining sample falls onto that screen and is screened, the proportion which passes through it is similarly determined, and so on until the sample has been screened on all the screens. The last side of the drum may be open (without a screen) so that it dumps the remaining "overs" into the collector.

In the operation of apparatus of this type it is observed that some "blinding" or screen clogging often occurs. Particles which are just slightly larger than the screen openings may become lodged in those openings; unless dislodged, they are thereby effectively removed from the sample. The useful screen area is also diminished, which can affect the standardizing of the cycle. It is therefore desirable to provide means for cleaning each screen, and for doing so in a manner such that the accuracy of the analysis is not adversely effected.

In using this type of apparatus, the drum is usually automatically indexed through the entire sequence of screens, and the whole operation may be carried out without manual control. It is therefore important that the cleaning also be carried out automatically, and in a manner to clean each screen surface without interfering with the screening action or the indexing cycle.

BRIEF DESCRIPTION OF THE INVENTION

In accordance with the preferred form of this invention, a screen cleaner is provided which is retracted from the drum during each screening step. The cleaner is moved into cleaning engagement with a screen of the drum just after the screening step on that screen, and before initiation of the next screening step. In other words, the drum is preferably cleaned between screenings, rather than during them, and the cleaner is retracted before the next screening step begins. Such retraction of the cleaning member from the drum during screening obviates the possibility that its contact with the drum might interfere with the screening motion, or cause undue wear.

Preferably the cleaner is a flat brush having a length (in the direction of the drum axis) equal to that of the screen plus the screening stroke length (so that the brush will clean the entire screen regardless of where it has stopped along its vibratory path). The brush is moved into contact with a screen as the screen is being indexed out of screening position. (If screening position is visualized as 6:00 on a clock, the position of the brush should be at about 5:00 or 7:00, depending on the direction of drum rotation.) The brush is positioned so that the indexing movement of the drum moves the screen being cleaned relatively past the brush, so that the entire screen surface is cleaned. Apart from the movement necessary to follow the contour of the drum, the brush need not be moved during cleaning, because the indexing movement of the screen past the brush is usually sufficient that clogging particles are dislodged. However, it is contemplated that the cleaner can also be rotated, oscillated or otherwise moved as necessary for effective cleaning movement for a given material.

The dislodged particles either fall back into the interior of the drum, where they become a part of the sample to be screened prior to the next screening, or they fall outside the drum into a collector which contains the particles that have already passed through the screen and been weighed. The particles dislodged tend to be just slightly larger than the openings of the screen beng cleaned, and would in large part pass through the larger openings of the next successive screen. Whether the dislodged particles are returned inside the drum or go directly into the collector after the prior weighing, they would in either case go into the fraction which passes the next screen. Provided the cleaning is completed after the previous weighing but prior to the next weighing, the size analysis is not distorted by cleaning in this manner, that is, the accuracy of the percentage analysis of the sample is not appreciably affected.

As indicated above, because the drum is vibrated linearly or otherwise shaken for screening, the cleaner is moved away for the drum during the actual screening steps in the analysis cycle. This may be accomplished by a cleaner moving means which is automatically actuated to move the cleaning means into contact with the drum so as to engage the screen to be cleaned. That screen is indexed out of screening position. The brush first engages the leading or initial edge of that screen, and maintains contact with the screen during the indexing movement. The moving means is actuated to remove the cleaning means from the drum after each indexing and cleaning step, and prior to the start of the next screening step.

The radial distance between the brush and the drum axis will vary as the drum indexes, because the drum is polygonal rather than circular. Means are provided so that the brush or other cleaner can ride on or follow the contour of the drum as it rotates. In the preferred embodiment a brush cleaner is mounted to pivot about an axis parallel to the axis of the drum; and biasing means such as a spring arm tends to bias the cleaning means toward the drum to maintain cleaning engagement, when the brush has been advanced to the cleaning position. The brush thus rides on the surface of the screen as the drum rotates the screen past the brush.

In an alternative embodiment, the cleaning means constantly rests on the drum, but during screening it is in engagement only with a non-screen part of the drum; it does not engage any screen surface during screening. In such position the cleaning member imposes little frictional resistance, and wear is reduced. In another embodiment the cleaning member, or a second cleaning member, is engaged with a screen other than the one in the down position, but for only a portion of the screening step, sufficient to provide a secondary cleaning action.

Figure 2:
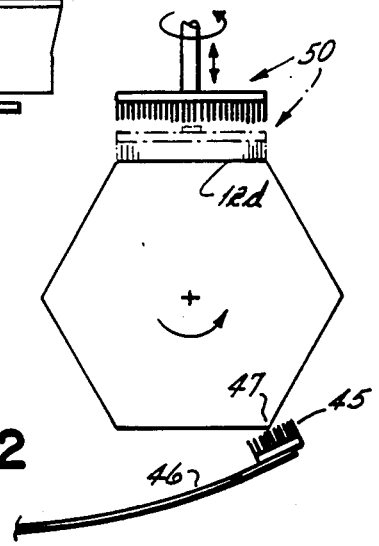

The invention can best be described by reference to the accompanying drawings, in which:

FIG. 1 is an end elevation, broken away and partly diagrammatic in nature, showing the presently preferred form of cleaner in accordance with the invention; and FIG. 2 is a diagrammatic elevation which shows an alternative embodiment of the invention.

The particle size analyzer in which the cleaner of the invention is incorporated may be in accordance with that shown and described in the previously identified Marrs U.S. Pat. No. 4,487,323, to which reference may be had and the disclosure of which is incorporated by reference herein.

Such a screener includes a drum 10 which is polygonal in shape, having a plurality of generally flat or planar sides or faces (six in the embodiment shown), each face being designated by 11. Screens 12*a, b, c, d,* and *e* (which may be woven mesh or apertured plates) are mounted on five successive faces 11 of the drum. The sixth side 11*f* of the drum is open; oversize particles are dumped through it at the conclusion of the separation. The sample to be analyzed is loaded into the drum through a chute 15 at the end thereof.

Indexing means, not shown but which may be as disclosed in the Marrs patent, rotates the drum abut its axis 16 in uniform angular increments, approximately 60° each in the hexagonal embodiment shown, so that the screens 12*a–e* are successively positioned at the lowermost or down position, at which screen 12*a* is shown in FIG. 1. The drum is rotated in the counterclockwise position, as shown by arrow 20.

Shaking means, not shown, imparts a linear or other screening motion to the drum in order to agitate the sample, which falls onto the down screen. The analyzer has a control means which determines the screening time for each screening step, and which directs the indexing means to rotate the drum to position the next larger screen size for screening, after a predetermined screening period. A collecting pan 18 receives particles which have passed through the down screen or which have fallen through or been dislodged from the drum, and they are weighed in the pan by an electronic scale 19. As explained in the Marrs patent, the apparatus preferably includes a microprocessor which receives as inputs the weights of each successive screened fraction from the scale 19 and calculates a percentage screen anaylsis.

A cleaning mechanism or means in accordance with the preferred form of the invention is generally indicated at 25, and includes a cleaning member 26 which may be a brush of sufficient length to engage the entire length of the screen, wherever the drum stops in its vibratory path.

Brush 26 is movable between two positions: (1) a retracted position which is shown in solid lines in FIG. 1; and (2) a cleaning position shown in dotted lines, in which it engages a screen as that screen is being indexed out of the screening position and while the next screen is being indexed into the screening position. Movement of the brush between the two positions is effected by a linear actuator 28, of type known of itself, wherein a rotary electric motor rotates a screw (not shown) to lineally advance or retract an arm 29.

At its upper end, actuator 28 is pivotally mounted to the frame of the analyzer. A connecting in 32 at the lower or outer end of arm 29 is slidably received in a slot 33 in a pivotable link 34. This link is mounted by a pivot 36 to the frame, and is rotated clockwise about this pivot when arm 29 is retracted. A biasing spring 38 tends to turn link 34 clockwise about pivot 36, in the direction of the arrow 39. Brush 26 is mounted to link 34 by a brush mounting arm 40. (A similar pivot may be provided to support the other end of the brush, not shown in FIG. 1.) Biasing spring 38 tends to turn the brush about pivot 36, to the extent permitted by the engagement of pin 32 with the end of slot 33.

When the brush is to be engaged with a screen for cleaning, the actuator is energized to retract arm 29. As pin 32 moves upward, away from the lower end of slot 33, spring 38 pulls the link clockwise, to follow the pin, so that the the brush swings toward the drum. The actuator is stopped after the drum has arrested the brush. When this occurs pin 32 is in approximately the middle of slot 33; this enables the link thereafter to move in either direction so that the brush can follow the contour of the drum as it indexes. Spring 38 exerts a cleaning force on the brush to hold it against the drum as it indexes. Once the brush 38 is engaged with the drum, the actuator need not be further operated to move the brush to follow the contour.

The microprocessor or machine controller operates the actuator to bring the brush first into engagement with a screen, preferably when the leading edge 42 of the respective screen is moving past the dotted line cleaning position of the brush. The brush remains in engagement with the screen until the next or following screen 12*b* has fully advanced to the down position. The entire width of the screen moves relatively across the brush and its entire surface is thereby cleaned. If needed, an auxiliary cleaning movement can be applied for greater cleaner action, for example, the brush can be a cylindrical brush which is rotated about an axis parallel to drum axis 16. It is also contemplated that the screening motion of the drum may be continued during the time the brush is engaged with the drum, to provide a stronger cleaning action. In this case the drum moves both longitudinally and transversely of the brush, as it is indexing.

In FIG. 1 it will be noted that collector 18 is sufficiently large to receive particles brushed from the screen which fall outside the drum, as well as those which fall from the screen in the active position. In effect these become part of the next fraction, and are weighed with it. A large proportion of them would pass the next screen, if they had remained in the drum, since they are just slightly larger than the openings of the previous screen.

FIG. 2 illustrates an alternative embodiment of the invention wherein the cleaning member is not retracted but remains in contact with the drum at all times. In this embodiment the cleaning member (a brush) 45 is mounted on a spring arm 46. The brush is positioned so that when the screening movement is applied to the drum, the brush engages the drum at a non-screen portion thereof, at the angle or corner 47 between its adjacent sides. At this position the brush is substantially disengaged from any screen surface, so that the brush is not much abraded by the screening motion of the drum, and does not impede screening.

It is also contemplated that in screening some types of particles, for example, elongated woodchips, "pin" chips may become so firmly stuck in the screen openings that a more intensive cleaning is desirable. For this purpose it is contemplated that the drum may be given a subsequent cleaning by a secondary cleaner 50. This cleaner is mounted to engage the screen at its topmost position, that is, the position of the screen 12*d*. This cleaner may be mounted on the end of a piston and is actuable to engage the drum at the top. The brush may be rotated to improve its cleaning action; alternatively or in addition, the screening movement of the drum can be continued during indexing to impart greater relative motion between the brush and screen. The cleaner 50 can then be retracted from the topmost screen during each screening step, so as not to interfere with screening. Since the primary cleaner has already removed all but the most tightly stuck particles, the analysis is not much affected by the return of these relatively few particles after an interim fraction has been weighed.

Having described the invention, what is claimed is:

1. In a particle size analyzer having a polygonal drum with graduated screens, means for rotationally indexing said drum so that said screens are successively positoned in a generally horizontal screening position for screening a sample, and means for imparting a longitudinal screening motion to the drum while each respective screen is in said screening position, a screening cleaning means comprising, a cleaning member, means mounting said cleaning member for movement toward and away from the drum, positioning means for moving said cleaning member into and out of engagement with said drum, and control means for operating said positioning means so that said cleaning member is engaged with a screen only while said drum is being indexed rotationally between screening positions, said positioning means retracting said cleaning member from said drum when any of said screens is in said horizontal screening position, sufficiently that said cleaning member does not interfere with said longitudinally screening motion while said sample is being screened on any of said screens.

2. The screen cleaning means of claim 1 further including means for creating cleaning movement between the cleaning member and the screen, said cleaning movement means comprising said means which indexes the drum.

3. The screen cleaning means of claim 1, further including means for creating cleaning movement between the cleaning member and the screen, said cleaning movement means comprising said means which imparts a screening motion to the drum.

4. The screen cleaning means of claim 1, further comprising a collector for receiving particles cleaned from said screen which fall outside the drum, so that such particles will be weighed with the next fraction of said sample.

5. The screen cleaning means of claim 1 further wherein said control means is responsive to operation of said indexing means whereby said positioning means moves said cleaning member into engagement with a screen while said indexing means is indexing said drum, and removes said cleaning member from said drum during screening.

6. The screen cleaning means of claim 1 wherein said cleaning member has a length substantially equal to the length of said drum plus the length of said longitudinal screening motion, so that said cleaning member engages the entire length of a screen, regardless of the position of stoppage of such screen in its longitudinal screening movement.

7. In the method of analyzing the sizes of particles of a mixture wherein the particles are screened in a generally horizontal screening position on progressively larger screens of an indexable polygonal drum and the fractions passing through the successive screens are weighed, some particles remaining lodged in the screens after screening, the method of dislodging such lodged particles comprising, bringing a cleaning member into cleaning engagement with the screen last screened upon while that screen is being indexed out of said horizontal screening position, maintaining engagement of the cleaning member with that screen until the cleaning member has acted upon the entire area of that screen, removing the cleaning member from engagement with that screen prior to further screening, and returning particles dislodged from that screen so that they fall into the previously screened and weighed material, their weight to be considered with the next screening fraction, or into the sample before the next screening step occurs.

* * * * *